US012303955B2

(12) United States Patent
Wang et al.

(10) Patent No.: US 12,303,955 B2
(45) Date of Patent: May 20, 2025

(54) METHOD FOR DIFFERENTIAL TEMPERATURE ROLLING OF COMPOSITE STRIPS BASED ON ACTIONS OF FRICTION ROLLER AND DEVICE THEREOF

(71) Applicant: TAIYUAN UNIVERSITY OF TECHNOLOGY, Shanxi (CN)

(72) Inventors: Tao Wang, Shanxi (CN); Changjiang Wang, Shanxi (CN); Yue Wu, Shanxi (CN); Peng Chen, Shanxi (CN); Jianchao Han, Shanxi (CN); Zhongkai Ren, Shanxi (CN); Yuanming Liu, Shanxi (CN); Qingxue Huang, Shanxi (CN)

(73) Assignee: TAIYUAN UNIVERSITY OF TECHNOLOGY, Shanxi (CN)

( * ) Notice: Subject to any disclaimer, the term of this patent is extended or adjusted under 35 U.S.C. 154(b) by 592 days.

(21) Appl. No.: 17/589,570

(22) Filed: Jan. 31, 2022

(65) Prior Publication Data

US 2022/0152675 A1 May 19, 2022

Related U.S. Application Data

(63) Continuation of application No. PCT/CN2020/136955, filed on Dec. 16, 2020.

(30) Foreign Application Priority Data

Oct. 19, 2020 (CN) ..... 202011119639.3

(51) Int. Cl.
*B21B 45/00* (2006.01)
*B21B 1/38* (2006.01)

(52) U.S. Cl.
CPC ..... *B21B 45/004* (2013.01); *B21B 1/38* (2013.01)

(58) Field of Classification Search
CPC ..... B21B 45/004; B21B 1/38; B21B 1/227; B21B 2001/386; B21B 2265/24;
(Continued)

(56) References Cited

U.S. PATENT DOCUMENTS 4,530,230 A * 7/1985 Monks ..... B21B 1/38 29/445
4,625,536 A * 12/1986 Morooka ..... B21B 37/46 72/10.3

(Continued)

FOREIGN PATENT DOCUMENTS

CN 201231253 Y * 5/2009
CN 103464505 B * 6/2015

(Continued)

OTHER PUBLICATIONS

Machine translation of CN-103464505-B (Year: 2015).*
Machine translation of CN-110369525-A (Year: 2019).*
Machine translation of CN-201231253-Y (Year: 2009).*

*Primary Examiner* — Jimmy T Nguyen
*Assistant Examiner* — Teresa A Guthrie

(57) ABSTRACT

A method for differential temperature rolling of composite strips based on actions of a friction roller includes steps of: S1: preparing a metal strip to be bonded, and performing surface treatment on the metal strip to be bonded; S2: frictionally heating the metal strip to be bonded by several sets of friction roller heating devices; measuring a surface temperature of the friction-heated metal strip to be bonded strip by a temperature detector; according to a measured temperature, adjusting a rotation speed of the friction roller in the friction roller heating devices; and S3: transporting the heated metal strip to be bonded to a rolling mill for rolling to obtain a metal composite strip. The invention adopts the friction roller heating devices in rolling process of the metal strip to be bonded.

2 Claims, 3 Drawing Sheets

(58) Field of Classification Search
CPC ..... B21B 27/005; B21B 2267/10; B21B 2261/20; B21B 2261/21; B21B 38/006; B21B 2275/04; B21B 2275/05; B21B 37/46; B21B 37/74; C21D 9/0012
USPC ..... 72/6.2, 363; 29/17.3, 17.4
See application file for complete search history.

(56) References Cited

U.S. PATENT DOCUMENTS 8,241,437 B2 * 8/2012 Utsunomiya ..... B21B 1/227 148/400
2022/0355356 A1 * 11/2022 Bergmann ..... B21B 38/006

FOREIGN PATENT DOCUMENTS

CN 105149353 A * 12/2015
CN 110369525 A * 10/2019

* cited by examiner

METHOD FOR DIFFERENTIAL TEMPERATURE ROLLING OF COMPOSITE STRIPS BASED ON ACTIONS OF FRICTION ROLLER AND DEVICE THEREOF

CROSS REFERENCE OF RELATED APPLICATION

This is a Continuation application of an International Application PCT/CN2020/136955, filed Dec. 16, 2020, which claims priority under 35 U.S.C. 119(a-d) to CN202011119639.3, filed Oct. 19, 2020.

BACKGROUND OF THE PRESENT INVENTION

Field of Invention

The present invention relates to the technical field of fabricating metal composite strips, and specifically relates to a method for differential temperature rolling of composite strips based on actions of a friction roller and a device thereof.

Description of Related Arts

Metal composite strip is a laminated composite material with both structure and functionality, which has a variety of excellent metal properties. In recent years, metal composite strip has been widely used in petrochemical, aerospace, national defense industry, transportation and household appliances, etc. The promotion and application of the metal laminated composite strip is of great significance to solve the prominent problems of the current energy structure and industrial structure. Common metal composites include steel/aluminum, copper/aluminum, magnesium/aluminum, etc., and applications of these composite materials in metallurgy, chemical, electrical and other industries have received great attention. At present, the main methods of fabricating metal composite strip comprise rolling, extrusion, explosion and diffusion welding. Compared with other bonding processes, rolling bonding has advantages of noiselessness, small impact on the environment, controllable production links, high production efficiency, high yield, and large product size, and has gradually developed into the mainstream way of producing metal composite strips.

For dissimilar metal rolled composite strip, the common problem is that the deformation resistance of dissimilar metals under identical temperature conditions is different, which makes the deformation of dissimilar metals inconsistent, resulting in low bonding strength of the metal composite strip, and prone to edge waves, middle waves and other problems in plate shapes. Differential temperature rolling is an effective rolling method that promotes the coordination of dissimilar metal deformation.

The current methods for differential temperature rolling of composite strips include: heating different metals to a specified temperature (See CN 109226263 A); heating only a single plate (See CN 106862271 A); and electromagnetic induction heating (See CN 105598166A). The first method has problems such as lengthy process and heat loss. The second method uses heat conduction to produce a temperature difference between the two metals, but the temperature control is not precise. Electromagnetic induction heating is only suitable for paramagnetic metals, and the heating speed is slow for other metals. In short, the above-mentioned methods for differential temperature rolling of composite strip has problems such as large energy consumption, complicated and cumbersome procedures and are greatly limited in application.

SUMMARY OF THE PRESENT INVENTION

In view of the above-mentioned problems, the present invention provides a method for differential temperature rolling of composite strips based on actions of a friction roller and a device thereof.

A method for differential temperature rolling of composite strips based on actions of a friction roller comprises steps of:

S1. preparing metal strips to be bonded, and performing surface treatment on the metal strip to be bonded;

S2. frictionally heating the metal strip to be bonded by several sets of friction roller heating devices; measuring a surface temperature of the friction-heated metal strip to be bonded by a temperature detector; according to a measured temperature, adjusting a rotation speed of the friction roller in the friction roller heating devices;

S3. transporting the heated metal strips to be bonded to a rolling mill for rolling to obtain a metal composite strip, wherein a rotation direction of the friction roller (9) in the step S2 is opposite to a rotation direction of a roller of the rolling mill.

Preferably, the friction roller heating device in step S2 comprises two brackets, two bearing seats are respectively provided in the two brackets, and a first bearing seat of the bearing seats located in a lower part is fixedly provided, a second bearing seat of the bearing seats located in an upper part is movably provided; an upper surface of the second seat of the bearing seats located in the upper part is connected with a pressing down device, wherein the pressing down device is installed on the two bracket, and the friction rollers are provided in the bearing seats corresponded on the two brackets, an end of the friction rollers is connected to an output shaft of the reducer through a cardan shaft, and an input shaft of the reducer is connected with an output shaft of the motor.

Preferably, an included angle between an axial direction of the friction roller in the friction roller heating device and a rolling direction of the metal strip to be bonded is greater than 0° and less than or equal to 90°.

Preferably, a pressing action of the friction roller on the metal strip to be bonded is within a range of its elastic deformation.

Preferably, the friction roller is a high-speed rotating roller with a rotation speed in a range of 2000-20000 r/min.

A device for differential temperature rolling of composite strips based on actions of a friction roller, comprises: two metal strip unwinders provided up and down, a temperature detection device, guide rollers, and a rolling mill and a composite strip winder;

wherein: a plurality of groups of friction roller heating devices are arranged behind both of the metal strip unwinders, an installing order of the metal strip unwinders, the friction roller heating device, the temperature detection device, the guide rollers, the rolling mill and the composite strip winder are: the metal strip unwinders, the friction roller heating device, the temperature detection device, the guide roller, the rolling mill, the guide roller and the composite strip winder in sequence;

wherein the friction roller heating device comprises two brackets, two bearing seats are respectively provided in the two brackets, and a first bearing seat of located in a lower part is fixedly provided, a second bearing seat of the bearing seats located in an upper part is movably provided; an upper surface of the second seat of the bearing seats located in the upper part is connected with a pressing down device, wherein the pressing down device is installed on the two bracket, and the friction rollers are provided in the bearing seats corresponded on the two brackets, an end of the friction rollers is connected to an output shaft of the reducer through a cardan shaft, and an input shaft of the reducer is connected with an output shaft of the motor.

Compared with the prior technologies, the present invention has beneficial effects as follows.

1. The present invention adopts friction roller heating device in the rolling process of a metal composite strip, and utilizes the friction and heat generation effect of the friction roller rotating at a high speed with the metal strip to be bonded, and generates different heat in the dissimilar metals by adjusting the speed of the friction roller, thereby generating different temperature rises to realize the differential temperature rolling of the metal composite strip, and independent heating of the metal strip to be bonded on one side.

2. The present invention adopts friction roller heating devices in the rolling process of the metal composite strip. The surface roughness of the upper and lower friction rollers in a group of friction devices can be different, and different friction coefficients are produced when they contact the upper and lower surfaces of the metal strip to be bonded. Combining the pressing of the friction roller and the high-speed rotation, the metal strip to be bonded forms a favorable temperature gradient along a thickness direction, which is beneficial to the structure and mechanical properties of the metal composite strip;

3. The present invention adopts the friction roller heating devices in the rolling process of the metal composite strip, which shortens the time required to heat up the metal composite strip to be bonded and reduces heat loss, regulates the speed of friction rollers through the feedback of the temperature detection device, and realizes the online accurate temperature control of the metal composite strip.

4. The present invention adopts friction roller heating devices in the rolling process of the metal composite strip. The metal surface is in contact with the friction roller to transfer heat from the metal surface to the entire metal, which reduces the temperature influence between dissimilar metals and makes the differential temperature rolling effects are remarkable.

5. The present invention adopts a friction roller heating device in the rolling process of the metal composite strip, wherein a direction of the friction force acting on the metal strip by the friction roller is opposite to the rolling direction, which can generate tension and is beneficial to reducing a thickness of the metal composite strip, improving production efficiency, coordinately controlling the tension by the displacement, rotation speed and surface roughness of the friction roller.

Figure 1:
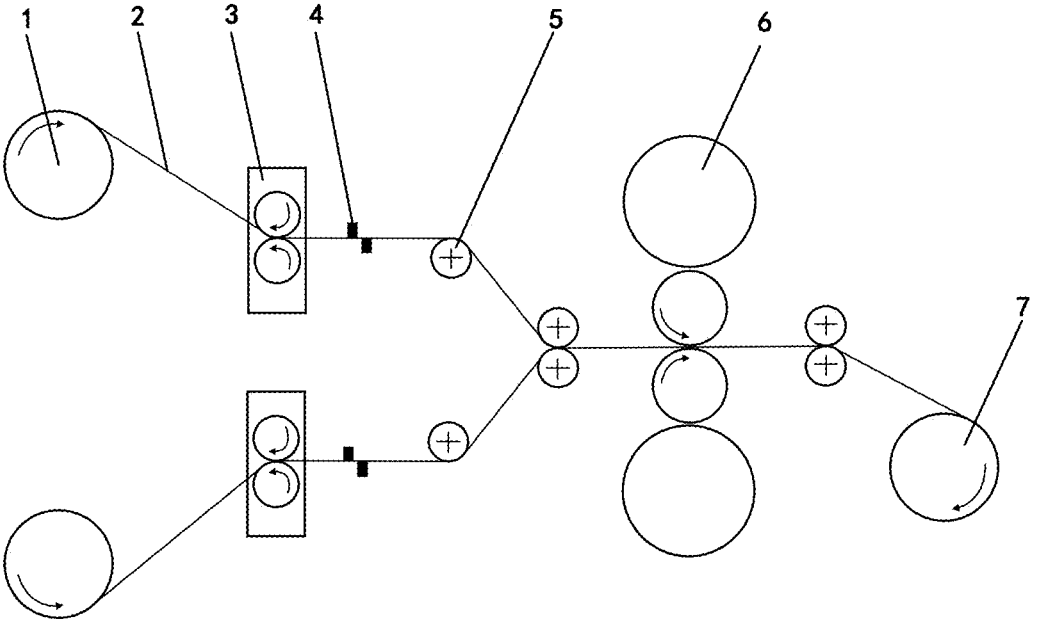
FIG. 1 is a two-dimensional schematic diagram of differential temperature rolling of composite strips based on actions of a friction roller of the present invention.
Figure 2:
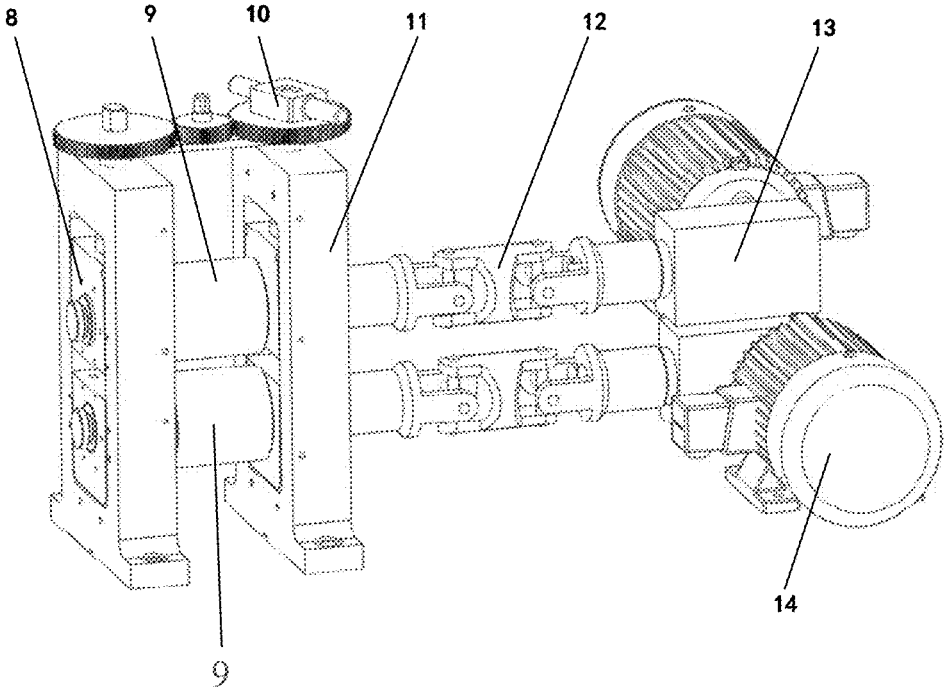
FIG. 2 is a structural schematic diagram of the friction roller heating device of the present invention.
Figure 3:
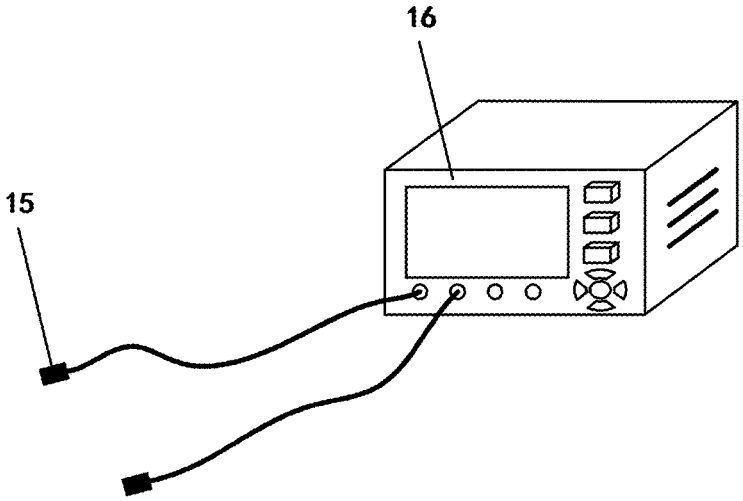
FIG. 3 is a schematic diagram of a temperature detection device implemented in the present invention.
Figure 4:
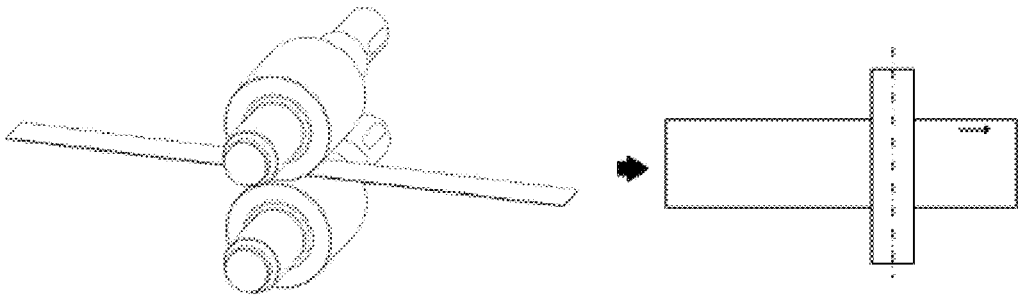
FIG. 4 is a schematic diagram of a vertical installation direction of the friction roller heating device.
Figure 5:
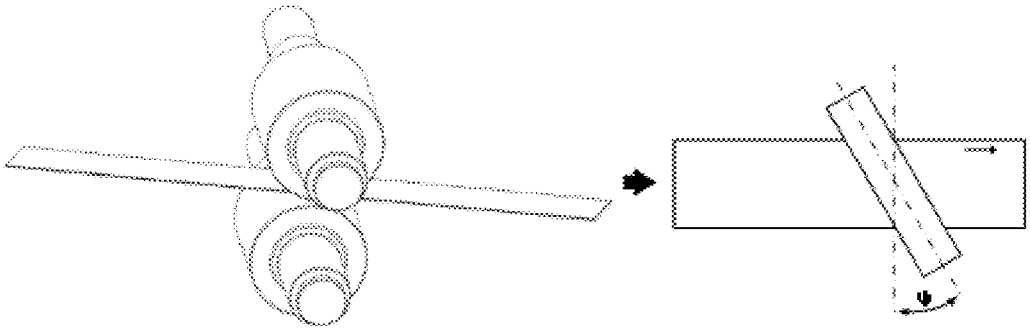
FIG. 5 is a schematic diagram of an oblique installation direction of the friction roller heating device.

In the drawings: 1—metal strip unwinders, 2—metal strip to be bonded, 3—friction roller heating device, 4—temperature detection device, 5—guide rollers, 6—rolling mill, 7—composite strip winder, 8—bearing seat, 9—friction roller, 10—pressing down device, 11—bracket, 12—cardan shaft, 13—reducer, 14—motor, 15—thermocouple, 16—temperature detector.

DETAILED DESCRIPTION OF THE PREFERRED EMBODIMENT

In order to further illustrate the technical solution of the present invention, the present invention will be further illustrated by the following examples.

Embodiment 1

Taking the differential temperature rolled magnesium-aluminum composite strip as an example, the width of the magnesium strip and the aluminum strip are both 60 mm, a thickness of the magnesium strip and the aluminum strip are both 0.5 mm, the magnesium strip is on the top, and the aluminum strip is on the bottom.

A method for different temperature rolling of composite strips based on the action of a friction roller comprises the following steps:

S1. preparing magnesium strips and aluminum strips, and performing surface treatment respectively on surfaces of the magnesium strips and aluminum strips to be bonded;

S2. frictionally heating the magnesium strip by several sets of friction roller heating devices 3, measuring a surface temperature of the magnesium strip after friction heating by a temperature detector 4, and adjusting the friction roller 9 in the friction roller heating device 3 according to the measured temperature; wherein a rotation speed is adjusted so that the temperature of the surface of the magnesium strip to be bonded up to 400° C., the temperature of the surface of the aluminum strip to be bonded up to 350° C., and an axial direction of the friction roller 9 in the friction roller heating device 3 is perpendicular to the rolling direction of the magnesium strip and the aluminum strip;

S3. transporting the heated magnesium strip and aluminum strip to the rolling mill 6 for rolling to obtain a metal composite strip, wherein a rotation direction of the friction roller 9 in the step S2 is opposite to a rotation direction of the roller of the rolling mill 6.

Further, the friction roller heating device 3 in the step S2 comprises two brackets 11, two bearing seats 8 are provided inside both of the brackets 11, and the bearing seat 8 located at a lower part is fixedly arranged, and a bearing seat 8 located at an upper part is movable. The upper surface of the upper bearing seat 8 is connected with a pressing down device 10, the pressing down device 10 is installed on the bracket 11, and a friction roller 9 is provided in the corresponding bearing seat 8 on the two brackets 11, so one end of the friction roller 9 is connected to the output shaft of the reducer 13 through a cardan shaft 12, and the input shaft of the reducer 13 is connected to the output shaft of the motor 14. A distance between the roller centers of the two friction rollers 9 is adjusted by the pressing down device to L=R1+R2+h, wherein R1 and R2 are radius of the two friction rollers 9; R1=R2=5 mm, wherein h=0.5 mm is a total thickness of the one-sided metal strip before rolling, ensuring the friction roller in contact with the magnesium strip, the pressing effect of the friction roller 9 on the magnesium and aluminum strip is within a range of their elastic deformation.

A device for differential temperature rolling of the composite strip based on actions of a friction roller, comprises: two metal strip unwinders 1 provided up and down, a temperature detection device 4, guide rollers 5, and a rolling mill 6 and a composite strip winder 7; wherein: a plurality of groups of friction roller heating devices 3 are arranged behind both of the metal strip unwinders 1; an installing order of the metal strip unwinders 1, the friction roller heating device 3, the temperature detection device 4, the guide rollers 5, the rolling mill 6 and the composite strip winder 7 are: the metal strip unwinders 1, the friction roller heating device 3, the temperature detection device 4, the guide roller 5, the rolling mill 6, the guide roller 5 and the composite strip winder 7 in sequence; wherein the friction roller heating device 3 comprises two brackets 11, two bearing seats 8 are respectively provided in the two brackets 11, and a first bearing seat of the bearing seats 8 located in a lower part is fixedly provided, a second bearing seat of the bearing seats 8 located in an upper part is movably provided; an upper surface of the second bearing seats 8 located in the upper part is connected with a pressing down device 10, wherein the pressing down device 10 is installed on the two bracket 11, and the friction rollers 9 are provided in the bearing seats 8 corresponded on the two brackets 11, an end of the friction rollers 9 is connected to an output shaft of the reducer 13 through a cardan shaft 12, and an input shaft of the reducer 13 is connected with an output shaft of the motor 14. The pressing down device 10 comprises a threaded column, wherein a lower end of the threaded column is connected with an upper surface of the bearing seat 8 in a limit position, and a lower end of the threaded column is rotatably connected with the bearing seat 8, and the threaded column is in threaded connection with the bracket 11. The upper part of the threaded column is fixedly connected with a large gear, and the two large gears are meshed and connected with a small gear. The small gear is mounted on a connecting plate, wherein the connecting plate is provided on the bracket 11. The upper end of threaded column is polygonal to facilitate the rotation of the threaded column. The temperature detection device 4 comprises a thermocouple 15 and a temperature detector 16.

Embodiment 2

Taking the differential temperature rolled steel-copper composite strip as an example, a width and thickness of the steel strip are 40 mm and 0.6 mm respectively, and a width and thickness of the copper strip are 40 mm and 1.5 mm respectively, with the copper strip on the top and the steel strip on the bottom.

A method for different temperature rolling of composite strips based on the action of a friction roller comprises the following steps:

S1. preparing copper strips and steel strips, and performing surface treatment on surfaces of the copper strips and steel strips to be bonded;

S2. frictionally heating the copper strip and steel strip by several sets of friction roller heating devices 3, and the surface temperature of the copper strips and steel strips after friction heating is measured by the temperature detector 4, and the friction roller is adjusted according to the measured temperature; wherein the rotating speed of the friction roller 9 in the heating device 3 makes the surface of the copper strip to be bonded up to 200° C., and the surface to be of the steel strip bonded up to 900° C.; taking the steel strip as an example, primarily setting a speed to make the surface of the steel strip to be bonded up to 800° C., gradually adjusting the speed of the friction roller 9 according to the temperature detected by the temperature detector; until the surface of steel strip to be bonded up to 900° C. The axis of the friction roller 9 in the friction roller heating device 3 is aligned with the copper strip and steel; wherein the included angle of the strip rolling direction is 45°;

S3. transporting the heated copper strips and steel strips to the rolling mill 6 for rolling to obtain metal composite strips, wherein the rotation direction of the rollers of the rolling mill 6 is opposite to the rotation direction of the friction roller 9.

Further, the friction roller heating device 3 in the step S2 comprises two brackets 11, two bearing seats 8 are provided inside both of the brackets 11, and the bearing seat 8 located at a lower part is fixedly arranged, and a bearing seat 8 located at an upper part is movable. The upper surface of the upper bearing seat 8 is connected with a pressing down device 10, the pressing down device 10 is installed on the bracket 11, and a friction roller 9 is provided in the corresponding bearing seat 8 on the two brackets 11, so one end of the friction roller 9 is connected to the output shaft of the reducer 13 through a cardan shaft 12, and the input shaft of the reducer 13 is connected to the output shaft of the motor 14. A distance between the roller centers of the two friction rollers 9 is adjusted by the pressing down device to L=R1+R2+h, wherein R1 and R2 are radius of the two friction rollers 9; h is the total thickness of the one-sided metal strip before rolling, R1=R2=5 mm, and the h on the copper strip side is 1.5 mm, h on the side of the steel strip is 0.66 mm, which ensures that the friction roller is in contact with the copper strip or the steel strip, and the pressure of the friction roller 9 on the steel strip and the copper strip is within a range of their elastic deformation.

A device for differential temperature rolling of the composite strip based on actions of a friction roller, comprises: two metal strip unwinders 1 provided up and down, a temperature detection device 4, guide rollers 5, and a rolling mills 6 and a composite strip winder 7; wherein: a plurality of groups of friction roller heating devices 3 are arranged behind both of the metal strip unwinders 1; an installing order of the metal strip unwinders 1, the friction roller heating device 3, the temperature detection device 4, the guide rollers 5, the rolling mill 6 and the composite strip winder 7 are: the metal strip unwinders 1, the friction roller heating device 3, the temperature detection device 4, the guide roller 5, the rolling mill 6, the guide roller 5 and the composite strip winder 7 in sequence; wherein the friction roller heating device 3 comprises two brackets 11, two bearing seats 8 are respectively provided in the two brackets 11, and a first bearing seat of the bearing seats 8 located in the lower part is fixedly provided, a second bearing seat of the bearing seats 8 located in the upper part is movably provided; an upper surface of the second seat of the bearing seats 8 located in the upper part is connected with a pressing down device 10, wherein the pressing down device 10 is installed on the two bracket 11, and the friction rollers 9 are provided in the bearing seats 8 corresponded on the two brackets 11, an end of the friction rollers 9 is connected to an output shaft of the reducer 13 through a cardan shaft 12, and an input shaft of the reducer 13 is connected with an output shaft of the motor 14. The pressing down device 10 comprises a threaded column, wherein a lower end of the threaded column is connected with an upper surface of the bearing seat 8 in a limit position, and a lower end of the threaded column is rotatably connected with the bearing seat 8, and the threaded column is in threaded connection with the bracket 11. The upper part of the threaded column is fixedly connected with a large gear, and the two large gears are meshed and connected with a small gear. The small gear is mounted on a connecting plate, wherein the connecting plate is provided on the bracket 11. The upper end of threaded column is polygonal to facilitate the rotation of the threaded column. The temperature detection device 4 comprises a thermocouple 15 and a temperature detector 16.

The diameter and surface roughness of the two friction rollers 9 in the same friction roller heating device 3 in the above-mentioned embodiment 1 and embodiment 2 may be different.

The main features and advantages of the present invention are shown and described above. For those skilled in the art, it is obvious that the present invention is not limited to the details of the above exemplary embodiments, and can be used without departing from the spirit or basic characteristics of the present invention. The present invention can be implemented in other specific forms. Therefore, from any point of view, the embodiments should be regarded as exemplary and non-limiting. The scope of the present invention is defined by the appended claims rather than the above description, and therefore it is intended to fall into the claims. All changes within the meaning and scope of the equivalent elements of are included in the present invention.

In addition, it should be understood that although this specification is described in accordance with the implementation modes, not each implementation mode only includes an independent technical solution. This narration in the specification is only for clarity, and those skilled in the art should regard the specification as a whole the technical solutions in the various embodiments can also be appropriately combined to form other implementations that can be understood by those skilled in the art.

What is claimed is:

1. A method for differential temperature rolling of composite strips based on actions of a friction roller, comprising steps of:

S1: preparing a metal strip to be bonded (2), and performing surface treatment on the metal strip to be bonded (2);

S2: frictionally heating the metal strip to be bonded (2) by a plurality of sets of friction roller heating devices (3), measuring a surface temperature of the friction-heated metal strip to be bonded (2) by a temperature detector (4); according to a measured temperature, adjusting a rotation speed of the friction roller (9) in the friction roller heating devices (3); the friction roller is a high-speed rotating roller with a rotation speed in a range of 2000-20000 r/min, utilizing a friction and heat generation effect of the friction roller (9) rotating at a high speed with the metal strip (2) to be bonded, heating both sides of the metal strip (2) to be bonded or an independent heating of the metal strip to be bonded on one side by adjusting the speed of the friction roller (9), thereby generating different temperature rises to realize the differential temperature rolling of the metal strip (2) to be bonded, each friction roller heating device of the plurality of sets of friction roller heating devices contains an upper friction roller and a lower friction roller, and that each friction roller meets all limitations described in the step S2 mentioned above, a surface roughness of each of the upper friction roller and the lower friction roller in the friction roller heating devices (3) is different, and different friction coefficients are produced when they contact the upper and lower surfaces of the metal strip (2) to be bonded; combining pressing of the friction roller (9) and the high-speed rotation, the metal strip (2) to be bonded forms a temperature gradient along a thickness direction, a direction of a friction force acting on the metal strip (2) to be bonded by the friction roller (9) is opposite to a rolling direction, which generates tension and reduces a thickness of the metal strip (2) to be bonded, coordinately controlling the tension by displacement, the rotation speed and the surface roughness of the friction roller (9);

S3: transporting the metal strip to be bonded (2) heated to a rolling mill (6) for rolling to obtain a metal composite strip, wherein a rotation direction of the friction roller (9) in the step S2 is opposite to a rotation direction of a roller of the rolling mill (6)

wherein a diameter and surface roughness of the two friction rollers (9) in a same one of the friction roller heating devices (3) are different;

wherein each of the friction roller heating devices (3) in step S2 comprises two brackets (11), two bearing seats (8) are respectively provided in the two brackets (11), and a first bearing seat of the bearing seats (8) at a lower part is fixedly provided, a second bearing seat of the bearing seats (8) at an upper part is movably provided; an upper surface of the second seat of the bearing seats (8) located in the upper part is connected with a pressing down device (10), wherein the pressing down device (10) is installed on the two brackets (11), and the friction rollers (9) are provided in the bearing seats (8) corresponded on the two brackets (11), an end of the friction rollers (9) is connected to an output shaft of a reducer (13) through a cardan shaft (12), and an input shaft of the reducer (13) is connected with an output shaft of a motor (14);

wherein an included angle between an axial direction of the friction roller (9) in the friction roller heating device (3) and a rolling direction of the metal strip (2) to be bonded is greater than 0° and less than or equal to 90°.

2. The method for differential temperature rolling of the composite strips based on actions of the friction rollers according to claim 1, wherein a pressing action of the friction roller (9) on the metal strip (2) to be bonded is within a range of elastic deformation of the metal strip (2) to be bonded.

* * * * *